US009568286B1

(12) United States Patent
Carrillo Fuentevilla et al.

(10) Patent No.: US 9,568,286 B1
(45) Date of Patent: Feb. 14, 2017

(54) ARCHERY TARGETS

(71) Applicant: SOLO OUTDOORS SA DE CV, San Pedro Garza García (MX)

(72) Inventors: Roberto Carrillo Fuentevilla, San Pedro Garza Garcia (MX); Jesus Cantu Rueda, San Pedro Garza Garcia (MX)

(73) Assignee: SOLO OUTDOORS SA DE CV, San Pedro Garza Garcia (MX)

( * ) Notice: Subject to any disclaimer, the term of this patent is extended or adjusted under 35 U.S.C. 154(b) by 0 days.

(21) Appl. No.: 14/959,707

(22) Filed: Dec. 4, 2015

(51) Int. Cl.
*F41J 3/00* (2006.01)
*F41J 1/00* (2006.01)
*F41J 1/10* (2006.01)

(52) U.S. Cl.
CPC ... *F41J 1/00* (2013.01); *F41J 1/10* (2013.01); *F41J 3/0004* (2013.01)

(58) Field of Classification Search
CPC ..... F41J 3/00; F41J 3/0004; F41J 1/10
USPC ..... 273/403, 404, 407, 408
See application file for complete search history.

(56) References Cited

U.S. PATENT DOCUMENTS 4,695,060 A * 9/1987 Pilgrim ..... F41J 3/0004 273/404
5,503,403 A * 4/1996 Morrell ..... F41J 3/0004 273/403
5,860,655 A * 1/1999 Starrett ..... F41J 3/0004 273/407
6,254,100 B1 * 7/2001 Rinehart ..... F41J 3/0004 273/403
7,455,298 B1 * 11/2008 Nettle ..... F41J 3/0004 273/403
7,784,794 B2 * 8/2010 Sitton ..... F41J 1/10 273/348
7,891,668 B2 * 2/2011 Box ..... F41J 3/0004 273/407
2002/0113372 A1 * 8/2002 Love ..... F41J 3/0004 273/408
2004/0108659 A1 * 6/2004 Pulkrabek ..... F41J 3/0004 273/404
2007/0290446 A1 * 12/2007 Amick ..... A61L 15/225 273/404
2008/0054570 A1 * 3/2008 Potterfield ..... F41J 5/24 273/403
2009/0134581 A1 * 5/2009 Box ..... F41J 3/0004 273/403

(Continued)

*Primary Examiner* — Mark Graham
(74) *Attorney, Agent, or Firm* — Elizabeth Philip Dahm; Kelly J. Kubasta; Ferguson, Braswell & Fraser, P.C.

(57) ABSTRACT

An archery target may allow target practice and/or simulate the shape of one or more animals. In various implementations, archery targets include a target body, a frame, and/or an overlay. A target body may include a first aiming zone, which protrudes from a first surface of the target body, and a second aiming zone, which protrudes from a second opposing surface. In some implementations, the first aiming zone and/or the second aiming zone may be off center. In some implementations, each aiming zone may be associated with an animal or group of animals. The orientation of the target body may be altered to select an aiming zone of the target body based upon user preference, in some implementations. The overlay may have shape similar to a predetermined animal. The overlay may be replaceable. A frame may at least partially support the target body and/or the overlay.

22 Claims, 7 Drawing Sheets

(56) References Cited

U.S. PATENT DOCUMENTS

| | | | | |
|---|---|---|---|---|
| 2012/0049460 | A1* | 3/2012 | Little | F41J 3/00 273/408 |
| 2012/0080848 | A1* | 4/2012 | McGovern | F41J 3/0004 273/408 |
| 2013/0270772 | A1* | 10/2013 | McGovern | F41J 3/0004 273/403 |
| 2014/0333029 | A1* | 11/2014 | McCarty | F41J 3/0004 273/408 |
| 2015/0253115 | A1* | 9/2015 | Hartcraft | F41J 1/10 273/403 |
| 2015/0276357 | A1* | 10/2015 | Peterson | F41J 3/0004 273/408 |

* cited by examiner

ARCHERY TARGETS

TECHNICAL FIELD

The present invention relates to archery targets.

BACKGROUND

Bow hunting is a skilled form of hunting game. Since clean kills with hunting are considered more difficult than with rifles, many bow hunters practice using archery targets. Many current archery targets are formed as life-size animals to provide an archer with realistic hunting conditions. These targets are often three-dimensional, molded foam game animals (e.g., a deer or a bear). However, these targets are expensive (e.g., costly to manufacture due to the size and detail of the target, due to the replacement cost of the entire animal upon repeat use, due to the need for multiple targets to practice different game), difficult to move (e.g., due to the size) and/or can only represent a single animal.

SUMMARY

In various implementations, an archery target may include a target body with one or more aiming zones. An aiming zone may be associated with one or more vital organ regions of a set of animals. The target block may include aiming zones that are associated with different sets of animals, in some implementations. The target block may be reoriented (e.g., rotated and/or flipped) to reorient an aiming zone and, for example, allow target practice on a different type of animal associated with the reoriented aiming zone.

In various implementations, an archery target may include a target body. The target body may include a width disposed between a first end and a second opposing end. The first end may include a first surface. The first surface may include a first central axis perpendicular to the width of the target body, and a first aiming zone disposed off center with respect to the first central axis of the first surface. The second end may include a second surface. The second surface may include a first central axis perpendicular to the width of the target body and a second aiming zone disposed off center with respect to the first central axis of the second surface. The first aiming zone may protrude from the first surface and/or the second aiming zone may protrude from the second surface.

Implementations may include one or more of the following features. The first aiming zone may correspond to a first set of animals and the second aiming zone may correspond to a second set of animals. The second set of animals may be smaller in size than the first set of animals, and wherein the second aiming zone is smaller in size than the first aiming zone. The orientation of the target body may be adjustable such that the target body may be at least one of rotated or flipped to reorient at least one of the first aiming zone or the second aiming zone of the target body. The first aiming zone may correspond to a vital organ region (e.g., a region that includes at least a portion of vital organ(s) of an animal) of a set of animals. In some implementations, the first surface further may include a second central axis perpendicular to the first central axis of the first surface and perpendicular to the width of the target body. The first aiming zone may be off-center with respect to the second central axis of the first surface. In some implementations, the second surface may include a second central axis perpendicular to the first central axis of the second surface and perpendicular to the width of the target body. The second aiming zone is off-center with respect to the second central axis of the second surface. The first aiming zone and/or the second aiming zone may be replaceable. The archery target may include a mounting frame coupled to the target block to at least partially support the target block, and an overlay similar to at least a portion of an animal. The overlay may be coupled to the target block. The overlay may include a two dimensional representation similar to an animal.

In various implementations, an archery target may include a target body. The target body may include a width disposed between a first end and a second opposing end. The target body may include a first end with a first surface. The first surface may include a first aiming zone, which protrudes from the first surface of the target body. The first aiming zone may include a first size corresponding to a first set of animals. The target body may include a second opposing end with a second surface. The second surface may include a second aiming zone, which protrudes from the second surface of the target body. The second aiming zone includes a second size which may correspond to a second set of animals. The second set of animals may be smaller in size than the first set of animals, and/or the second aiming zone is smaller in size than the first aiming zone.

Implementations may include one or more of the following features. The first surface may include a first central axis perpendicular to the width of the target body, and the first aiming zone may be disposed off center with respect to the first central axis of the first surface. The second surface may include a first central axis perpendicular to the width of the target body, and the second aiming zone may be disposed off center with respect to the first central axis of the second surface. The archery target may include an overlay coupled to the target body. The overlay may be replaceable. The archery target may include a mounting frame coupled to the target body. The mounting frame may allow the target body to be reoriented and the height of target body to be adjusted.

In various implementations, an archery target may include a target body, a mounting frame coupleable to the target body, and a replaceable overlay. The target body may include a width disposed between a first end and a second opposing end. The target body may include a first end with a first surface. The first surface may include a first aiming zone, which protrudes from the first surface of the target body. The first aiming zone may include a first size corresponding to a first set of animals. The target body may include a second opposing end with a second surface. The second surface may include a second aiming zone, which protrudes from the second surface of the target body. The second aiming zone may correspond to a second set of animals. The second set of animals may be smaller in size than the first set of animals and/or the second aiming zone may be smaller in size than the first aiming zone. The mounting frame may at least partially support the target body. The replaceable overlay may be similar to at least a portion of an animal.

Implementations may include one or more of the following features. The mounting frame may include adjustable legs. The mounting frame may be directly coupled to the target body. The archery target may include a mounting strap disposed at least partially around a periphery surface of the target body. The mounting strap may couple the mounting frame and the target body. The mounting strap may allow rotation of the target body. The mounting strap may include pockets. Pocket(s) may receive at least a portion of one or more legs of the mounting frame.

The details of one or more implementations are set forth in the accompanying drawings and the description below.

Other features, objects, and advantages of the implementations will be apparent from the description and drawings.

BRIEF DESCRIPTION OF THE DRAWINGS

For a more complete understanding of this disclosure and its features, reference is now made to the following description, taken in conjunction with the accompanying drawings, in which.

Like reference symbols in the various drawings indicate like elements.

DETAILED DESCRIPTION

Archery targets may be used to improve shooting accuracy, to practice archery, in contests, and/or for sport. In various implementations, an archery target includes a target body with an aiming zone. A user may shoot an arrow with an intention of hitting the aiming zone, in some implementations. The archery target may include a frame and/or overlays. The frame may at least partially support an orientation and/or a height of the target body. The overlay may couple with the frame and/or the target body. The overlay may resemble an animal or portion thereof, in some implementations.

During use, the archery target receives a pointed projectile, such as an arrow. The archery target may be designed to receive and retain at least a portion of an arrow that strikes the arrow with a predetermined minimum force (e.g., the archery target may be able to receive and retain an arrow striking with approximately 86 foot pounds). If the arrow strikes the target body of the archery target, the momentum of the arrow is stopped (e.g., by the foam of the target body). For example, arrows may travel at approximately 40 to approximately 400 feet per second and the archery target may stop the arrow and retain at least a portion of the arrow (e.g., a tip section) in the archery target. The arrow may be retained in the target body until a user removes the arrow. In some implementations, if the arrow strikes an overlay but not the target body, the arrow may pass through the overlay.

Figure 1A:
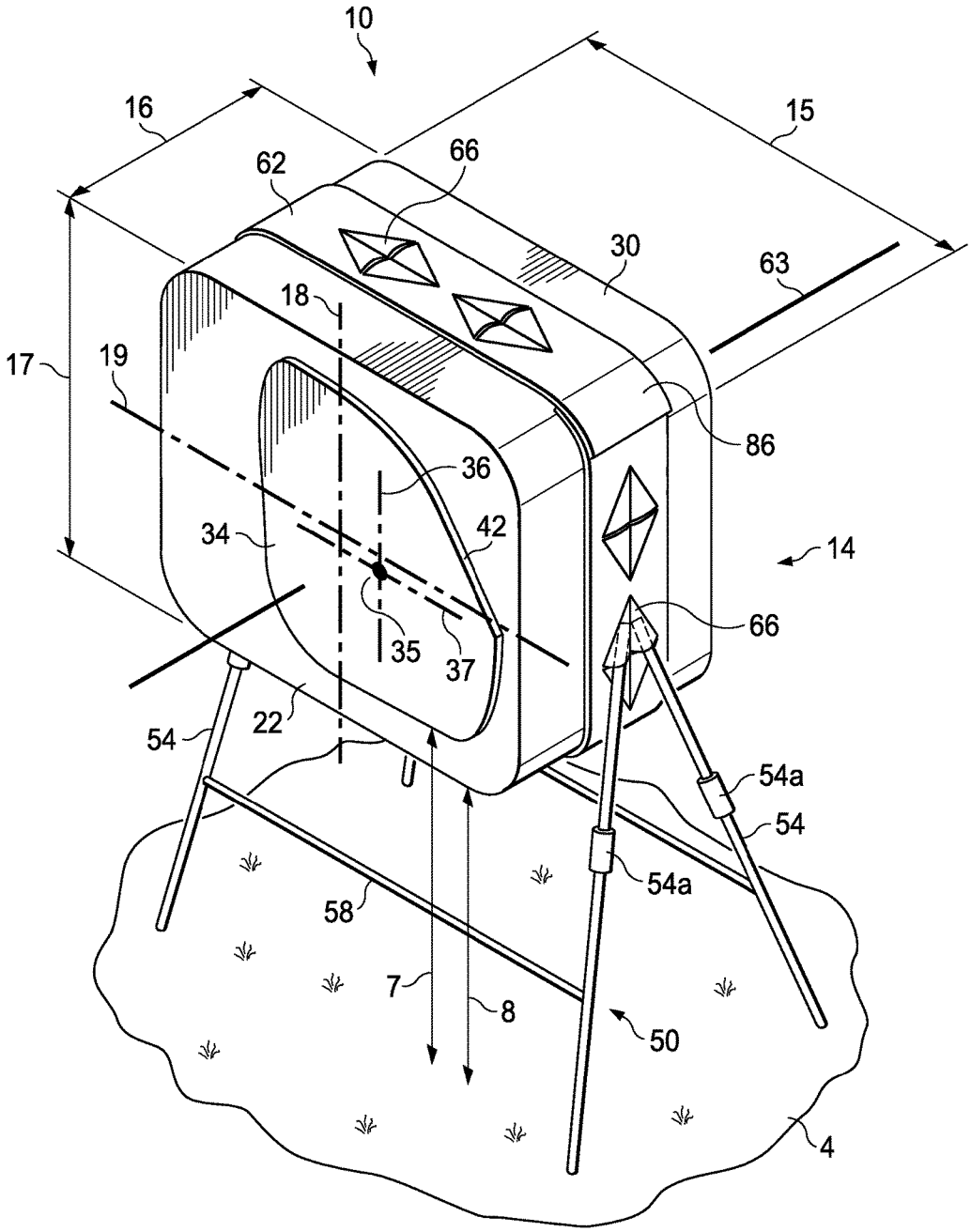
FIG. 1A illustrates a perspective view of an implementation of a first side of an example archery target.

FIG. 1A illustrates an implementation of an example archery target 10. As illustrated, an archery target includes a target body 14 and a mounting frame 54. The target body may include materials and/or a size to quickly stop incoming arrows (e.g., not allow arrows to pass though the target body). The target body may allow arrows to be removed (e.g., pulled out) from the target body 14 without lubricant or a removal device, in some implementations.

The target body 14 may be solid, porous, cellular, any other appropriate structure, or combinations thereof. The target body 14 may include any appropriate material, such as molded polyurethane foam. The target body 14 may be self-healing. The density of the target body may be approximately uniform. In some implementations, the target body may include more than one density across a length, height, and/or width of the target body. For example, a target body may include more than one aiming zone, and one or more of the aiming zones may have a different density than another aiming zone(s).

In some implementations, the target body may include materials (e.g., polyurethane foam) similar in density to one or more parts (e.g., vital organs) of animal(s). By simulating the density of an animal or portion thereof, arrow penetration under hunting conditions may be more closely approximated using the archery target.

The target body may have any appropriate regular or irregular shape. As illustrated, the target body may have a cuboid shape. The target body may be spherical, cylindrical, trapezoidal prism and/or in other appropriate shapes. The edges of the target body may be sharp and/or rounded.

The target body 14 may have a length 15, a width 16, and a height 17. The target body 14 may include a first center axis 18 approximately perpendicular to the length 15 and approximately parallel to the height 17. The target body 14 may also include a second center axis 19 approximately perpendicular to the height 17 and approximately parallel to the length 15.

The target body 14 may include a first surface 22, at a first end of the target body, and an opposing second surface 26, at a second opposing end of the target body. The target body 14 may include one or more other surfaces between the first end and the second end of the target body. The target body may include a peripheral surface 30 extending at least partially around the target body 14 and between the first end and the second end of the target body.

The first surface 22 and/or the second surface 26 may include aiming zones. The aiming zones may be the primary target areas in which arrows are shot, in some implementations. For example, the aiming zone may represent a vital organ region of an animal. A vital organ region may be an area of a predetermined animal that includes at least a portion of one or more vital organs.

The aiming zone may include one or more of the same materials or different materials than the target body. For example, the aiming zone may include polyurethane foam. An aiming zone that protrudes from a surface of the target may be formed by adding additional layers of material, by carving out regions proximate the aiming zone, by injection molding the target body with the protrusions formed in the mold, thermomolding the target body with protrusions formed in the mold, and/or any applicable process.

As illustrated, the target body 14 may include a first aiming zone 34 on the first surface 22 of the target body and a second aiming zone 38 on the second surface 26 of the target body. An aiming zone may protrude at a height 42 from a surface of the target body 14. For example, the first aiming zone 34 may be a protrusion extending from the first surface 22 and the second aiming zone 38 may be a protrusion extending from the second surface 26.

In some implementations, the aiming zone (e.g., the first aiming zone and/or the second aiming zone) may be off-center with respect to the target body. An aiming zone may have a centroid 35 and a central axis 36 passing through the centroid and parallel to a respective the central axis of the target body. The aiming zone may be off-center with respect to the first central axis 17 of the target body 14 and/or off-center with respect to the second central 18 axis of the target body. For example, a first central axis of the aiming zone may not be the same as the first central axis of the target body. As illustrated, the first central axis of the aiming zone is disposed adjacent to (e.g., to the right side) of the first axis of the target body. In some implementations, a second central axis 37 of the aiming zone may not be the same as the second central axis 18 of the target body 14. As illustrated, the second central axis 37 of the aiming zone is disposed adjacent to (e.g., below) the second axis of the target body 14. In some implementations, an aiming zone may be off-center with respect to the target body and a greater proportion of the volume of the aiming zone may be disposed a first quadrant of the target body than at least one other quadrant (e.g., a target body is divided into quadrants by the first and the second central axes).

Utilizing a target body with an aiming zone off-center may allow the position of the aiming zone relative to the ground (e.g., and/or the user) to be adjusted. For example, if a target body 14 is rotated (e.g., 90 degrees, 180 degrees, and/or 270 degrees), a height 7 of an aiming body from the ground may be adjusted. As illustrated in FIG. 1A, if the target body 14 is rotated counterclockwise, the height of the aiming zone 34 from the ground will be increased. If the target body 14 is rotated clockwise, the height 7 of a portion of the aiming zone may be increased and a height of another portion of the aiming zone may not be increased (e.g., due to the shape of the aiming zone). In some implementations, adjusting the orientation of the target (e.g., rotating, coupling via a different pocket, etc.) may adjust the height 8 of the target body 14 from the ground 4. Thus, user satisfaction may be increased since different target heights (e.g., corresponding to different types of animals or target practice) may be allowed with a single target body. For example, a first orientation of the target body may be associated with an aiming zone for moose vital organs, while a second orientation of the target body (e.g., 90 degree rotation clockwise, 90 degree orientation counterclockwise, 180 degree rotation, 270 degree rotation) may be associated with an aiming zone for deer vital organs.

In some implementations, the target body may include different or similar aiming zones positioned on opposing surfaces of the target body. By utilizing a target body with different aiming zones (e.g., different shapes, different sizes, and/or different orientations), the target body may allow more types of target practice, such as practicing aiming on different animals. For example, a first aiming zone may be associated with a first set of animals (e.g., large animals) and/or may be larger than a second aiming zone that may be associated with a second set of animals (e.g., smaller animals that the first set of animals).

Figure 1B:
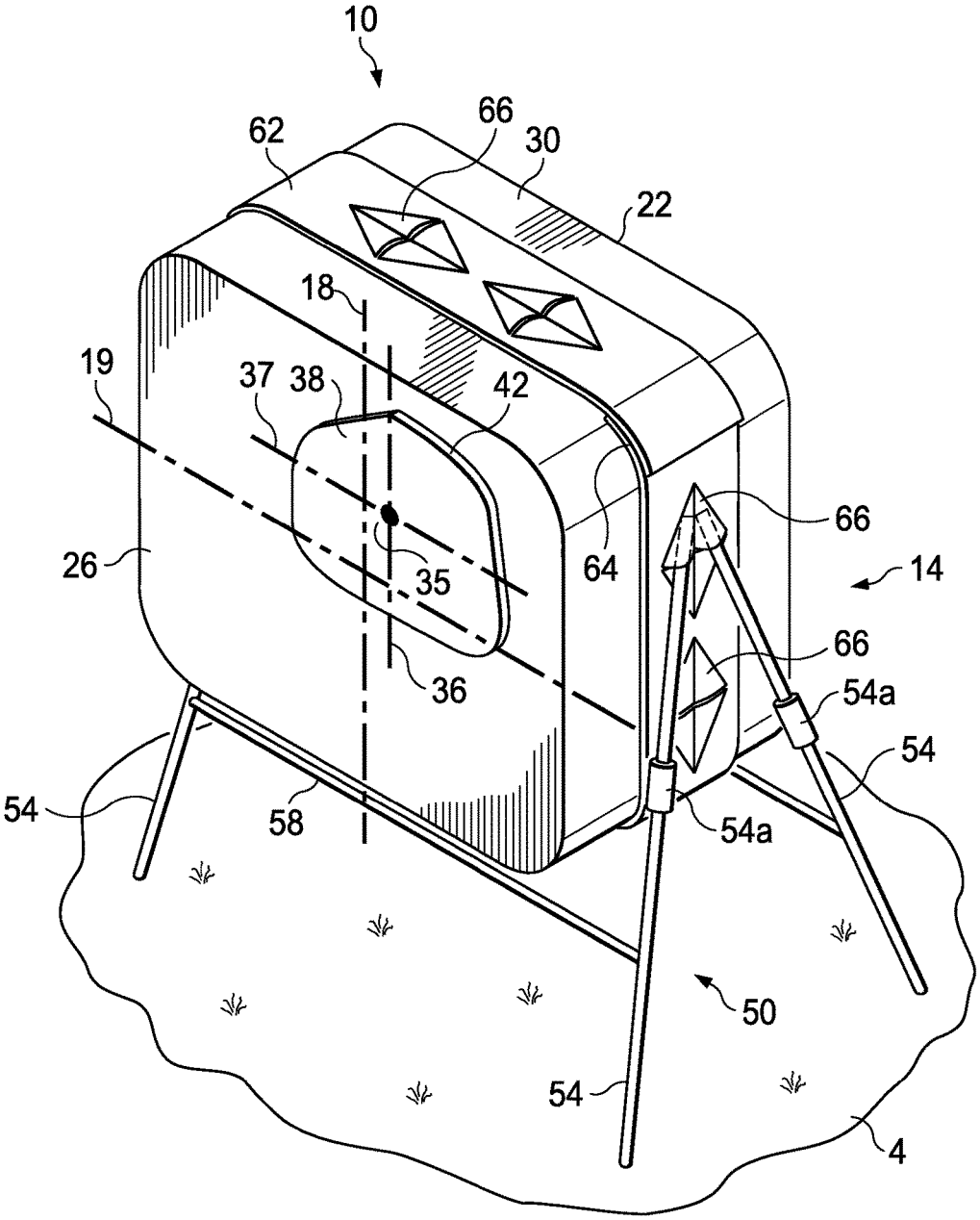
FIG. 1B illustrates a perspective view of an implementation of a second side of the example archery target, illustrated in FIG. 1A.

As illustrated in FIGS. 1A and 1B, the target body 14 includes a first surface 22 with a first aiming surface 34 and a second opposing surface 26 with a second aiming zone 38. The first surface 22 may include a relatively large aiming zone 34 (e.g., compared to the second aiming zone 38), which may be shaped to correspond with the size and/or location of vital organs of corresponding to larger game animals, and the second surface 26 includes a relatively small aiming zone 38 (see FIG. 1B) shaped to correspond with the size and/or location of vital organs of smaller game animals. The aiming zone(s) (e.g., first aiming zone 34 and/or second aiming zone 38) includes a height 42 so that the aiming zone(s) protrude from a surface of the target body. As illustrated, each aiming zone 34, 38 includes a shape corresponding to a vital organ region of a predetermined set of animals (e.g., one or more animals). For example, an first aiming zone 34 that is relatively large in size, as illustrated in FIG. 1A, may correspond to the vital organ region of large game animals such as deer, elk, goats, moose, lions, bears, and/or buffalo. A second aiming zone 38 that is smaller in size (e.g., when compared to first aiming zone 34), as illustrated in FIG. 1B, may correspond to the vital organs region of smaller game animals (e.g., lower to the ground and/or smaller in size), such as fox, turkey, coyote, raccoon, and/or javelina.

Although FIGS. 1A and 1B illustrate a first aiming zone that larger is than a second aiming zones, other configurations may be utilized as appropriate. For example, a first aiming zone may be smaller than the second aiming zone. The first aiming zone and the second aiming zone may be approximately the same size. In some implementations, the first aiming zone and/or the second aiming zone may include more than one protrusion (e.g., to represent particular vital organs and/or regions of an animal; to represent targets for archery competitions; and/or to increase adjustability of the target body).

In some implementations, user satisfaction may be increased by allowing a user to practice archery on large and/or small game animals using the same target body (e.g., since multiple archery targets may not need to be purchased, since targets may not need to be moved to make room for additional targets, etc.). For example, a user may reverse the target body 14 on a mounting frame 50 to select the aiming zone 34 as the active target (FIG. 1A) or the aiming zone 38 (FIG. 1B) as the active target. As shown in FIG. 1A, when compared to FIG. 1B, the target body 14 is positioned (e.g., on the mounting frame 50) at a location that is lower to the ground than as shown in FIG. 1B.

In some implementations, the archery target may utilize a mounting frame in conjunction with the target body. The mounting frame 50 may couple to the target body 14 to at least partially support the target body in a position. The mounting frame 50 may have any appropriate size and/or shape. The mounting frame 50 may be adjustable (e.g., height, width, length) to accommodate different positions, different target bodies, and/or different orientations of the target body, for example. As illustrated in FIGS. 1A and 1B, the mounting frame 50 may include one or more legs 54. The legs of the mounting frame may rest upon the ground and/or may be staked into the ground (e.g., via tapered leg ends, footings, etc.). The legs of the mounting frame may include one or more height-adjustable legs 54 with a height adjustment mechanism 54*a* (e.g., ratcheting legs, crank adjustable legs, slot and tab adjusting legs, etc.). The legs 54 of the mounting frame may have any appropriate size and/or shape (e.g., tubular). In some implementations, the legs 54 of the mounting frame 50 may be disposed to extend downwardly and away from each other at a fixed angle and/or engage with the ground 4. The mounting frame 50 may include cross member(s) 58, which extend between the legs 54 to increase stability of the mounting frame 50 (e.g., when compared with a mounting frame without cross members). The cross member(s) 58 may be coupled to the legs 54 by any appropriate means (e.g., welding, bolting, etc.).

The mounting frame 50 may be coupled to the target body to inhibit damage to arrows due to contact with the mounting frame. For example, the mounting frame may have a shape and/or couple with the target body such that the components of the frame do not reside in the path between an aiming zone and an arrow from a user. The mounting frame may couple (e.g., directly or indirectly) with the target body on one or more peripheral surfaces 30 of the target body, in some implementations. As illustrated in FIGS. 1A and 1B, a mounting strap 62 may be utilized to couple the target body 14 and the mounting frame 50. For example, the mounting strap 62 may be disposed to wrap at least partially around the peripheral surface 30 of the target body 14 and at least partially support the target body 14 on the mounting frame 50. In some implementations, the mounting strap 62 contacts the peripheral surface 30 and tautly wraps around the peripheral surfaces of the target body. In some implementations, ends of the mounting strap 62 may couple to proximate each other via fasteners 64 such as (e.g., by hook and loop fastening such as Velcro®, snap fastening, buttons, and/or various suitable mechanisms).

In some implementations, the mounting strap may facilitate the adjustment of the orientation of the target body. For example, the mounting strap may include pockets 66. The pockets receive at least a portion of the mounting frame (e.g., at least a portion of leg(s)). As illustrated in FIGS. 1A and 1B, an outer surface of the mounting strap 62 may include one or more groups of mounting pockets 66. The mounting pockets 66 may be disposed at approximately equidistant positions along the length of the mounting strap 62.

In some implementations, a mounting pocket 66 may include a material such as pliable sheet material. The mounting pocket 66 may be any suitable size and/or shape (e.g., square, triangle, other regular polygon shaped and/or irregularly shaped). Mounting pocket(s) 66 may be coupled to (e.g., via glue, stiches, staples, etc.) and/or formed in (e.g., integral) the outside surface of the mounting strap 62. The mounting pocket 66 may include a closed end and an open end, in some implementations, which are arranged to receive leg(s) 54 of the mounting frame 50. In some implementations, a mounting pocket is sized and/or shaped to receive, in the mounting pocket, at least a portion of leg(s) 54 of a mounting frame 50. By utilizing mounting pockets 66 at different locations along the mounting strap 62, the target body 14 may be supported upon the mounting frame 50 in an elevated position (FIG. 1A), in a lowered position (FIG. 6) that is closer to the ground, and/or in a variety of other appropriate positions.

The mounting pockets 66 may be arranged in groups (e.g., groups of four pockets per group) with one pair of mounting pockets 66 facing an opposing pair, as illustrated in FIGS. 1A and 1B. Thus, the target body 14 may be, for example, flipped and mounted to the mounting stand 50 via the opposing pair of mounting pockets in the group. By utilizing multiple mounting pockets and/or groups of opposing mounting pockets the target body may be disposed in any one of multiple orientations.

Figure 2:
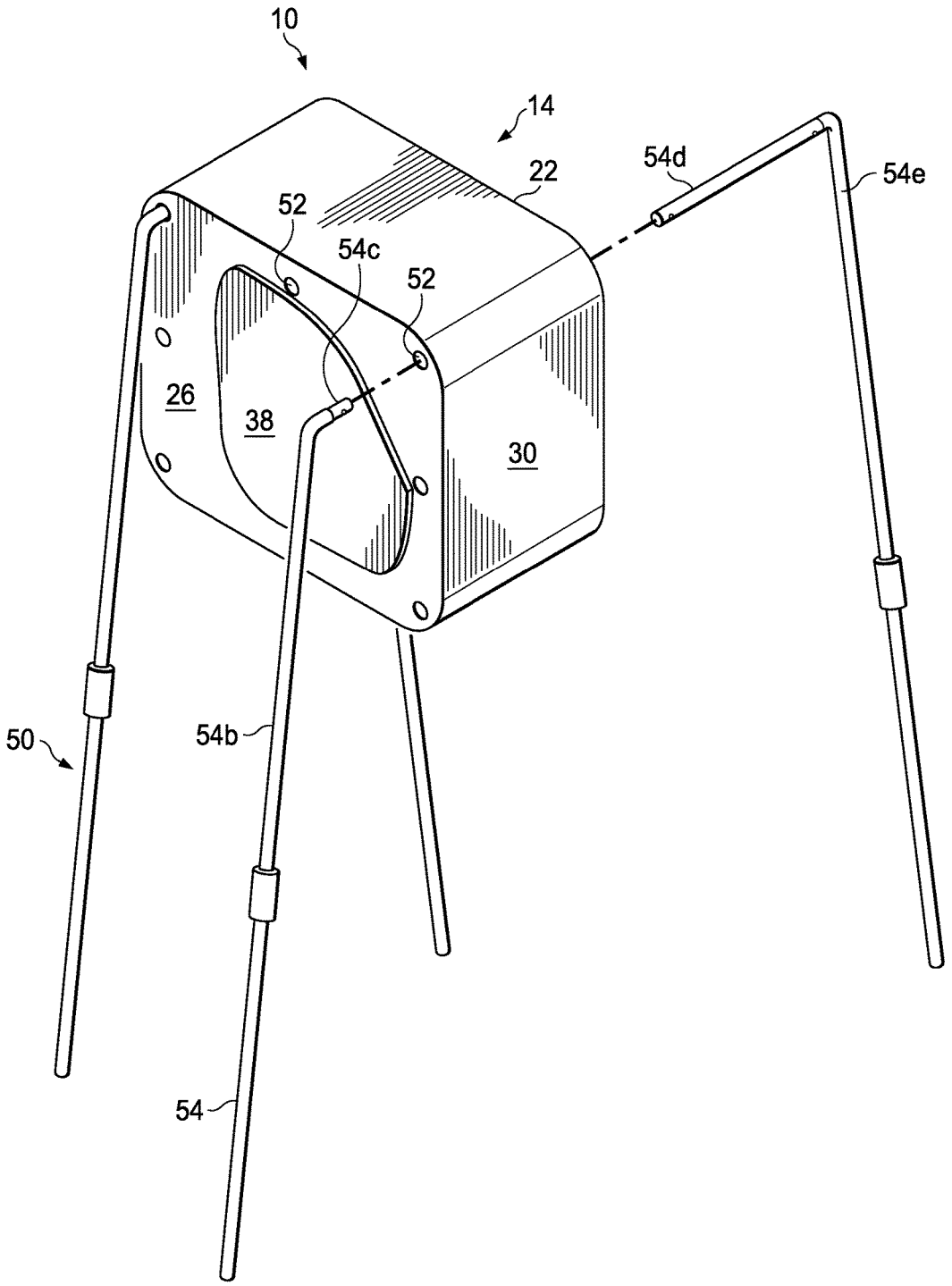
FIG. 2 illustrates a perspective view of an implementation of an example archery target.

In some implementations, the mounting strap may include leg straps that extend from the mounting strap and couple with and/or around leg(s) of the mounting frame. In some implementations, the mounting strap may couple to the target body directly, indirectly (e.g., via hook and loop, clips, snap fastening, screws, and/or other appropriate fasteners) or a combination thereof. FIG. 2 illustrates an implementation of an example archery target in which the mounting frame is directly mounting to the target body. The target body 14 includes openings 52 through the target body. An opening 52 may receive at least a portion of leg(s) 54 of the mounting frame 50. As illustrated, two opposing legs be disposed at least partially in an opening 52 and may couple to each other to at least partially support the target body 14. The first leg 54*b* may include a portion 54*c* that can be disposed in a hollow portion 54*d* of the second opposing leg 54*e*, in some implementations. In some implementations, the legs may couple via fasteners (e.g., bolts through an opening in a leg, threaded legs, etc.)

The archery target may include one or more overlays. The overlay may include any appropriate material, such as animal skin, synthetic animal skin, plastic (e.g., polypropylene), polymer, foam, cardboard, or combinations thereof. The overlay may be a layer coupled to the target body, mounting strap, and/or mounting frame. In some implementations, the overlay may be coupled directly to the target body and a frame may not be utilized to support the target body (e.g., the target body may be placed on the ground, on a fence, in a tree, and/or in other appropriate locations). The overlay may resemble a portion of an animal (e.g., skin, fur, coloring, pattern, etc.) to provide a more simulated hunting experience for a user, for example. The overlay may be self-healing. An overlay may be replaceable. For example, a user may replace the overlay with a similar or different overlay (e.g., after prolonged use, after damage of an overlay, to practice a different animal, based on external environmental factors, etc.).

In some implementations, the overlay may include a 2 dimensional (2D) representation of an animal or portion thereof. For example, the overlay may include a 2D deer, moose, fox, or other appropriate animal. In some implementations, the overlay may include a 3D animal or portion thereof. The target block may be positioned in the 3D animal overlay and may be repositioned. For example, the target block may be positioned and/or secured in a first position (e.g., to practice aiming on a first vital organ associated with a first aiming zone); then, the user may reposition and/or secure the target block (e.g., by rotating, flipping or otherwise reorienting the target block) to practice aiming on a second vital organ associated with a second aiming zone or with the first aiming zone in a second orientation. In some implementations, the target block and/or portions thereof (e.g., aiming zone(s)) may be replaceable in the 3D overlay. For example, a first target block may utilized with a 3D overlay and a user may remove the first target block and replace it with a second target block (e.g., to practice on a different aiming zone, to replace a worn or damaged target block, etc.). In some implementations, a first target block may utilized with a 3D overlay and a user may remove one or more first aiming zones from the first target block and replace it with one or more second aiming zones (e.g., to replace a worn or damaged target block). The mounting frame may be coupled to and/or integral with the 2D or 3D overlay.

The overlay may be coupled to the target body in some implementations. For example, a strap may couple the overlay to the target body, fasteners (e.g., screws, brads, tabs, etc.) may couple the overlay to the body, etc. In some implementations, the overlay may frictionally couple with (e.g., be retained by) the target body.

In some implementations, the archery target may include a plurality of replaceable overlays. The replaceable overlays may be associated with the same, similar, and/or different animals. For example, one or more overlays in a set may each be shaped in the form of an animal. A user may select an overlay based on user preference during use the archery target.

Figure 3:
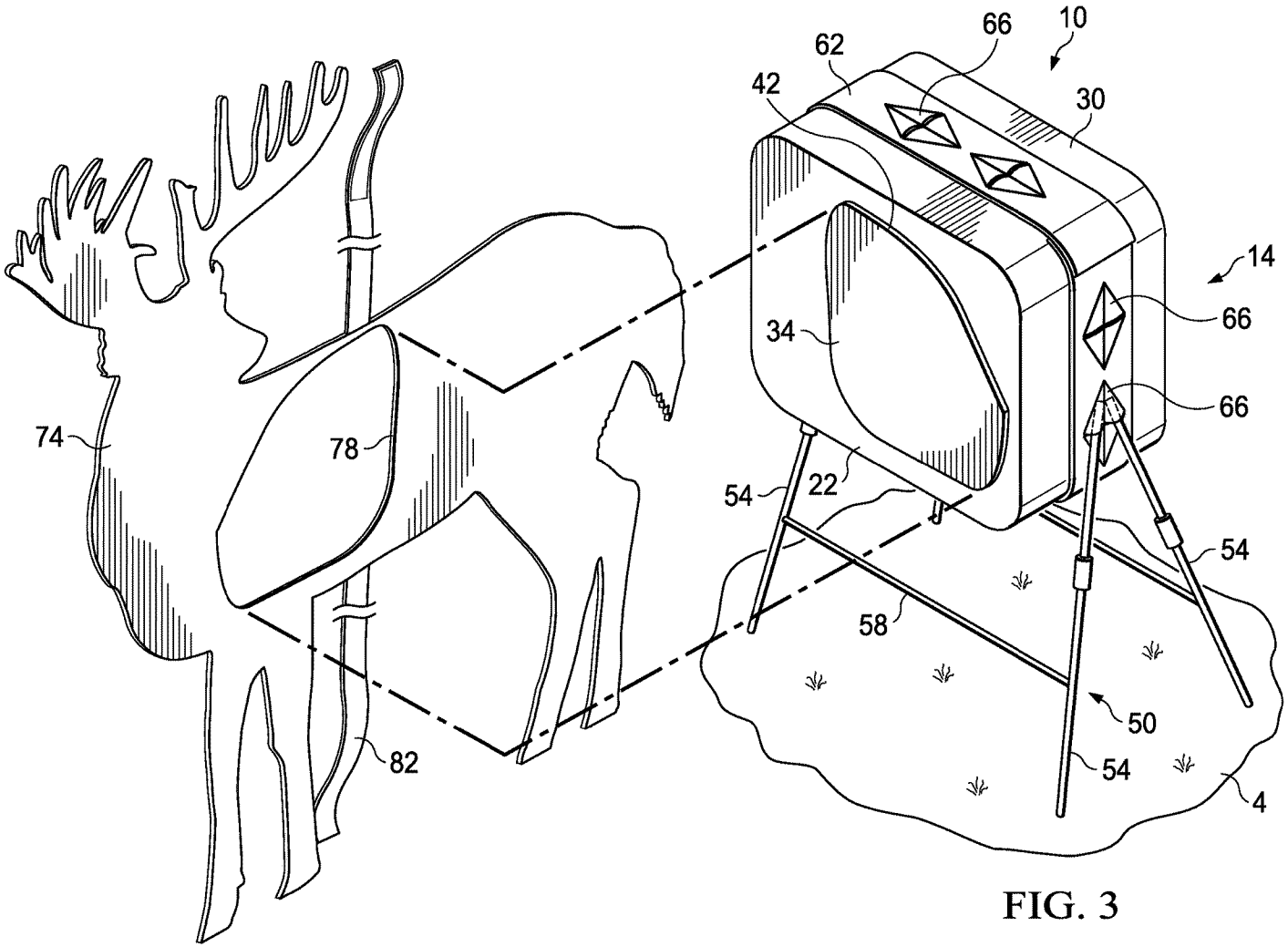
FIG. 3 illustrates a partially exploded perspective view of an implementation of an example archery target.
Figure 4:
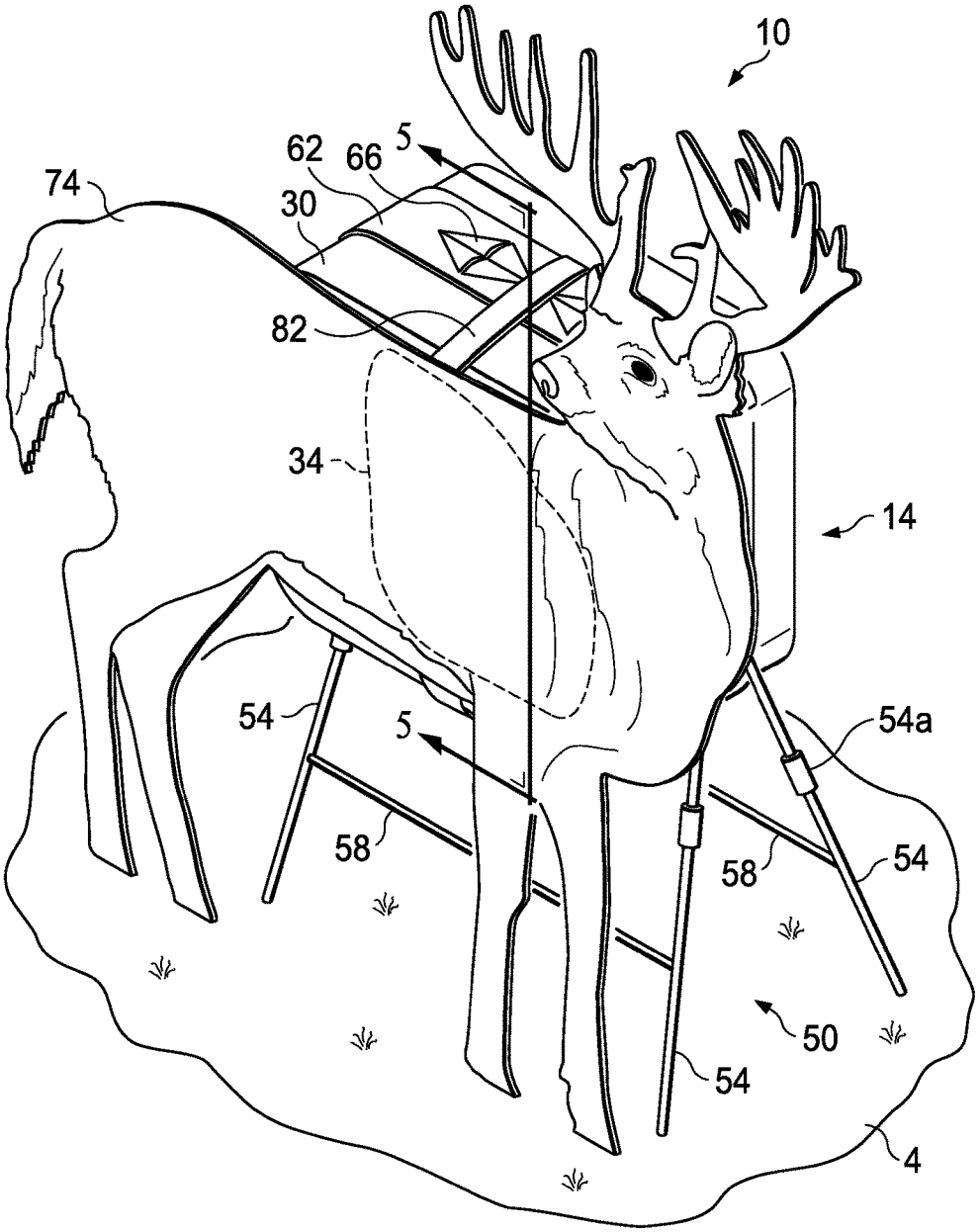
FIG. 4 illustrates a perspective view of an implementation of the example archery target illustrated in FIG. 3.

In some implementations, an overlay may include one or more aiming zone apertures. An aiming zone aperture may allow at least a portion of the aiming zone of the target block to be visible to a user. For example, at least a portion of the aiming zone of the target block may be disposed in and/or protrude through the aiming zone opening of the overlay. As illustrated in FIGS. 3 and 4, aiming zone aperture 78 may be extend through the overlay and be positioned such that at least one aiming zone of a target block may be positioned in the aiming zone aperture. Allowing the aiming zone to be visible and/or accessible via at least one aiming zone aperture of the overlay may reduce wear on the overlay and/or facilitate visualization of a target for aiming (e.g., since the aiming zone may be more apparent without the overlay covering at least a portion of the aiming zone).

Figure 6:
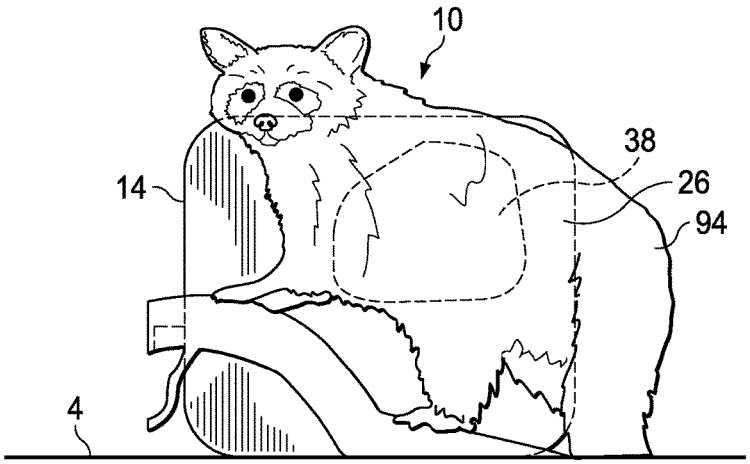
FIG. 6 illustrates a front view of an implementation of an example archery target.

In some implementations, the overlay may cover at least a portion of one or more aiming zones of a target block. As illustrated in FIG. 6, the overlay may cover at least a portion of the target block that includes the aiming zone. In some implementations, the protrusion of the aiming block from the target block may be visible to a user even when covered with an overlay (e.g., the aiming zone may protrude to cause displacement of the overlay) and/or may be apparent to a user when touching the archery target to determine if arrows pierced the aiming zone and/or when removing the arrow(s). (e.g., by feeling the aiming zone protruding from the target block).

In some implementations, during use, a user may adjust an orientation of a target body and/or a position (e.g., height, length, and/or width) of the mounting frame based at least partially upon the type of game animal to be practiced upon. For example, the user (e.g., a bow hunter and/or instructor) may elevate or lower the target body 14. The user may rotate the target body 14 (e.g., along a rotational axis 63, first central axis 17, and/or second central axis 18) through four incremental 90 degree orientations to select one of at least two landscape orientations or one of at least two portrait orientations. In some implementations, different orientations of the aiming zone(s) may correspond with vital organ regions of different game animals.

Figure 7:
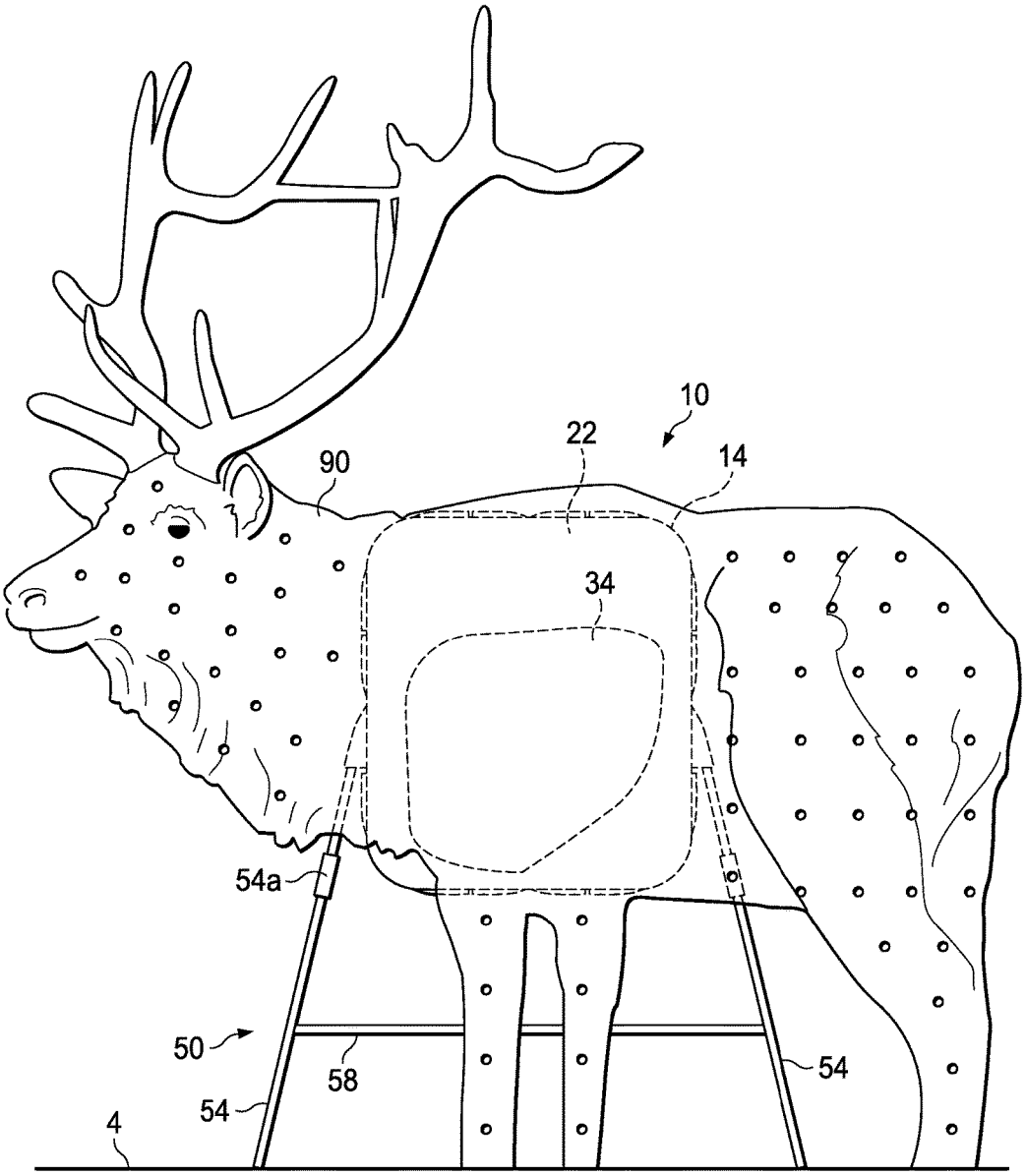
FIG. 7 illustrates a front view of an implementation of an example archery target.

In some implementations, the aiming zones 34, 38 may be located off-center so that as the target body is placed in different orientations, the aiming zones 34 change in position and orientation. For example, referring to FIG. 1A, the target body 14 may be situated in a first landscape position where the aiming zone 34 is positioned to correspond with the location of the vital organs of a deer. The target body 14 may be rotated by approximately 90 degrees counterclockwise from the first landscape position to a first portrait position, as illustrated in FIG. 7, wherein the aiming zone 34 corresponds with the location of the vital organs of an elk. The target body 14 may be rotated through two additional 90 degree increments to reposition the target body 14 to a second landscape and to a second portrait position wherein the aiming zone 34 corresponds with the location of vital organs of other large game animals. In some implementations, as illustrated in FIG. 6, the target body 14 may be reversed (e.g., relative to FIG. 1A) to make the aiming zone 38 the active target, which is selected by the user. The target body 14 may be rotated to a landscape position wherein the aiming zone 38 corresponds with the location of vital organs of a raccoon or other small game animals.

In some implementations, a target block may be able to represent vital organ areas (e.g., via the aiming zones) for a plurality of animals based on the orientation of the target block. For example, the height of the target block from the ground and/or the height of the aiming from the ground may be adjusted by rotating the target. The height of the aiming zone from the ground may be associated with a group of animals, and so rotating the target block to adjust the height of the aiming zone from the ground may adjust the group of animals with which the aiming zone is associated. In some implementations, rotating the target block may adjust orientation of the shape of the aiming zone and may adjust the animals associated with the adjusted target block.

In some implementations, an aiming zone may be associated with a set of animals, such as large game (e.g., standing bear, moose, elk, and/or buffalo), medium game (e.g., sheep, goat, deer, and/or antelope), small game (e.g., javelina, coyote, turkey, and/or bobcat), and mini game (e.g., rabbit, squirrel, raccoon, and/or prairie dog). A target may include an aiming zone on each of two opposing sides. The aiming zones may represent two different sets of animals, in some implementations. For example, a first aiming zone may be associated with large game and a second aiming zone may be associated with small game. A first aiming zone may be associated with mini game and a second aiming zone may be associated with small game, in some implementations. In some implementations, rotation of an aiming zone may also alter the set of animals associated with the aiming zone. For example, if a first aiming zone associated with large game is rotated 90 degrees clockwise, it may be associated with small game; and/or if a second aiming zone is associated with small game is rotated 90 degrees clockwise, it may be associated with medium game.

In some implementations, overlay may cover a target block. The target block may protrude so that at least a portion of the target block is visible to user through the overlay. In some implementations, the overlay may include an aperture in which the target block is at least partially disposed (e.g., at least a portion of an aiming zone may extend through and/or be disposed in the aperture).

In some implementations, the target body and/or the overlay may be self-healing. The target body may enable the target body to at least partially withstand a plurality of arrow punctures and arrow withdrawals (e.g., the target body may be used repeatedly over a time period). The overlay may include one or more layers, in some implementations. For example, the overlay may include a self-healing layer and at least one other layer (e.g., polypropylene, foam, etc.). In some implementations, the overlay may reduce the speed of an arrow passing at least partially through the self-healing layer.

In various implementations, one or more components of the archery target may be replaced. For example, the overlay, the mounting frame, the target body, the aiming targets, and/or portions thereof may be replaced. As archery targets are repeatedly used, overlays may wear prior to, concurrent with, and/or after the target block. Allowing replacement of the overlay separate from other components may decrease costs associated with use of the archery target and/or increase the lifetime of the overall archery target. In some implementations, the target block and/or portions thereof (e.g., aiming targets) may be replaced. For example, an extra layer of foam may be added to the archery target (exterior and/or an interior addition) or portions thereof. In some implementations, a leg of the frame may break, and by allowing replacement of a mounting frame or portions thereof, the lifetime of the target block may be extended and/or costs associated with use may be decreased (e.g., since the broken part may be replaced and working parts may be salvaged).

In some implementations, one or more of the aiming zones may be replaceable. For example, as a user strikes arrows into the aiming zone, the aiming zone may have greater wear than other portions of the target block (e.g., other aiming zones and/or other portions of the target block). The user may replace the aiming zone(s) with greater wear to allow further use of the same target block. By allowing replacement of an aiming zone of the target block, the lifetime of the target block may be extended (e.g., when compared with a target block without replaceable aiming zone(s)). User satisfaction may be increased since less waste may be created (e.g., since parts that are worn are recycled or thrown away rather than the whole target block), operational costs may be decreased (e.g., since worn parts are replaced rather than the entire target block, etc.

In some implementations, to allow the aiming zones to be replaceable the target block may allow removal and replacement of the aiming zones. For example, the target block may include one or more apertures to receive an aiming zone. The aperture(s) of the target block may extend at least partially through a width of the target block. An aiming zone may be received by an aperture and coupled to the target block. For example, the aiming zone my frictionally fit in the aperture of the target block (e.g., the aperture may have a size and shape to receive an aiming zone). The aiming zone may be at least partially disposed in an aperture and/or coupled (e.g., glued, secured via hook and loop fastener, secured via snap coupling, etc.) to at least a portion of the target block, in some implementations. In some implementations, an aperture may be sized and/or shaped to receive a predetermined aiming zone (e.g., large animal vital organ zone, small animal vital organ zone, etc.).

Although implementations of the target body have been described as including a first aiming zone and a second aiming zone. In some implementations, the target body may include one or more additional aiming zones disposed on the same surface as the first aiming zone and/or a different surface (e.g., portion of peripheral surface and/or same surface as the second aiming zone). In some implementations, the first aiming zone and/or the second aiming zone may include a set of one or more aiming zones.

In some implementations, more than one target body may be used in an archery target. For example, an overlay may be coupled (e.g., directly or indirectly) to more than one target body. In some implementations, an archery target may include a mounting frame capable of coupling to more than one target body. For example, a plurality of target bodies may be coupled to the mounting frame to allow a user to practice on multiple target bodies (e.g., corresponding to different animals or the same animals) and/or to allow a plurality of users to practice on a plurality of target bodies (e.g., the same or different target bodies in the same or different orientations).

In some implementations, overlays may include openings to allow air to pass, as illustrated in FIG. 7. The openings to allow air to pass may be disposed across the entire overlay or portion(s) thereof. For example, the overlay may include a mesh. The openings to allow air to pass may be the openings or voids in the mesh. The openings to allow air to pass in the overlays may include any appropriate shape and/or size. For example, the openings to allow air to pass may be slits in the overlay. Wear due to weather (e.g., wind gusts) and/or wear due to entry of arrows (e.g., from stretching the overlay upon entry of the arrow) may be reduced (e.g., compared to overlays without openings to allow air to pass). In some implementations, the overlays may not include openings, as illustrated in FIG. 6.

EXAMPLES

Example 1

Figure 5:
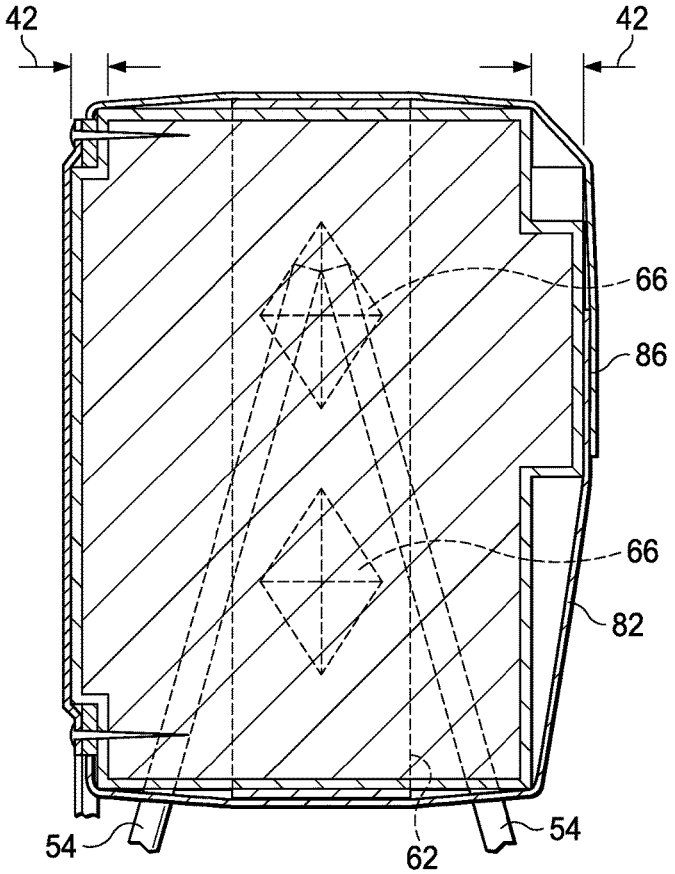
FIG. 5 illustrates a cross-section taken along line 5-5 of an implementation of the example archery target illustrated in FIG. 4.

For example, a user may select a replaceable overlay may be size and/or shaped in the form of a large game animal. FIG. 3 illustrates a partially exploded view of an archery target. FIG. 4 illustrates a front perspective view of an implementation the archery target in FIG. 3, and FIG. 5 illustrates a cross-section at line 5-5 of the implementation of the example archery target illustrated in FIG. 4. As illustrated, the replaceable overlay 74 is shaped similar to a large deer. The overlay may include an aiming zone aperture 78 corresponding with the size and location of a deer's vital organs. The large deer overlay 74 may include a strap 82 to couple the overlay 74 to the target body 14.

The target body 14 may be supported upon the mounting frame 50 in a variety of positions based at least partially on user preferences for the type of animal with which to practice. For example, the user (e.g., bow hunter) may choose to practice marksmanship skills for deer hunting. For this type of practice, the target body 14 may be positioned in a landscape orientation and placed in an elevated position upon the mounting frame 50 utilizing mounting pockets 66. Also, the target body 14 is oriented with the aiming zone 34 facing the bow hunter to serve as the active target. With the target body 14 positioned and oriented as such, the height and orientation of the aiming zone 34 corresponds with the vital organs of a large deer. As shown in FIGS. 3-5, the large deer overlay 74 may be secured to the target body 14 by passing the protruding aiming zone 34 through the aperture 78 and securing the large deer overlay 74 to the target body 14 by use of strap 82 which may be wrapped over the target body 14 and attached to itself by various suitable mechanisms (e.g., a hook and loop fastening system 86 such as Velcro®).

The target body 14 may be supported above the ground 4 by utilization of a mounting frame 50. In some implementations, the target body 50 may be positioned directly upon the ground.

Example 2

In some implementations, the user (e.g., bow hunter) may choose to practice marksmanship skills for elk hunting. FIG. 7 illustrates an implementation of an example archery target. The replaceable overlay is shaped in the form of a large elk 90, and includes an aperture that is located and shaped to correspond with a large elk's vital organs. The replaceable overlay 90 may be shaped in the form of other large game animals including but not limited to moose, lions, bears, and buffalo. For this type of target practice, the target body 14 may be positioned in a portrait orientation and placed upon the mounting frame 50 in the elevated position, as shown in FIG. 7. Also, the target body 14 is oriented with the aiming zone 34 serving as the active target. With the target body 14 positioned and oriented as such, the height and orientation of the aiming zone 34 corresponds with the vital organs of a large elk. The large elk overlay 90 may be secured to the target body 14 utilizing a strap m a similar manner to that described above.

Example 3

In some implementations, the user (e.g., bow hunter) may choose to practice marksmanship skills for hunting raccoon. Referring now to FIG. 6, as the raccoon is a small game animal, the support frame 50 may be dispensed with entirely and the target body 14 may be placed directly upon the ground 4. For this application the target body 14 is reversed so that the aiming zone 38 for small game animals serves as the active target. With the target body 14 positioned and oriented as such, the height and location of the aiming zone 38 corresponds with the vital organs of a small raccoon. In this manner, the small raccoon overlay 94 may be secured to the target body 14 in similar manner as discussed above. In some implementations, the replaceable overlay may be shaped in the form of other small game animals including but not limited to foxes, turkeys, coyotes, raccoons, or javalinas, etc. In accordance with the present invention, as described above, the target body 14 may be elevated, lowered, oriented in portrait or landscape positions, and/or rotated to utilize either aiming 34 or 38 to match the vital organs of various game animals.

End of Examples

Although implementations have described the archery target as being struck by an arrow, other pointed projectiles may be used with the described systems and processes, as appropriate.

Although implementations have described that the archery target includes a body coupled to a mounting frame and/or overlay, the target body may be utilized without the mounting frame (e.g., directly on the ground, with other mounting frames, with 3D replicas, etc.). In some implementations, the target body may or may not be coupled with an overlay.

Although users have been described as a human, a user may be a person, a group of people, a person or persons interacting with one or more computers, and/or a computer system.

It is to be understood the implementations are not limited to particular systems or processes described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise. Thus, for example, reference to "a aiming zone" includes a combination of two or more aiming zones and reference to "a foam" includes different types and/or combinations of foams.

Although the present disclosure has been described in detail, it should be understood that various changes, substitutions and alterations may be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. An archery target comprising:

a target body, wherein the target body comprises:

a width disposed between a first end and a second opposing end;

the first end comprising a first surface, wherein the first surface comprises:

a first central axis perpendicular to the width of the target body; and a first aiming zone disposed off center with respect to the first central axis of the first surface, wherein the first aiming zone protrudes from the first surface; and the second end comprising a second surface; wherein the second surface comprises:

a first central axis perpendicular to the width of the target body; and a second aiming zone disposed off center with respect to the first central axis of the second surface, wherein the second aiming zone protrudes from the second surface; and a mounting frame coupleable to the target body, wherein the mounting frame at least partially supports the target body; and a mounting strap, wherein the mounting strap is disposed at least partially around a periphery surface of the target body, and wherein the mounting strap couples the mounting frame and the target body; and an overlay similar to at least a portion of an animal.

2. The archery target of claim 1 wherein the first aiming zone corresponds to a first set of animals, and wherein the second aiming zone corresponds to a second set of animals, and wherein the second set of animals are smaller in size than the first set of animals, and wherein the second aiming zone is smaller in size than the first aiming zone.

3. The archery target of claim 1 wherein the orientation of at least one of the first aiming zone or the second aiming zone is adjustable by at least one of rotating or flipping the target body.

4. The archery target of claim 1 wherein the first aiming zone corresponds to a vital organ region of a set of animals.

5. The archery target of claim 1 wherein the first surface further comprises a second central axis perpendicular to the first central axis of the first surface and perpendicular to the width of the target body, and wherein the first aiming zone is off-center with respect to the second central axis of the first surface.

6. The archery target of claim 1 wherein the second surface further comprises a second central axis perpendicular to the first central axis of the second surface and perpendicular to the width of the target body, and wherein the second aiming zone is off-center with respect to the second central axis of the second surface.

7. The archery target of claim 1 wherein at least one of the first aiming zone or the second aiming zone is replaceable.

8. The archery target of claim 1 wherein the overlay is coupled to the target block and comprises a two dimensional representation similar to an animal.

9. The archery target of claim 1 wherein the mounting frame allows the target body to be reoriented, and wherein the mounting frame allows a height of the target body to be adjusted.

10. The archery target of claim 1 wherein the overlay includes one or more aiming zone apertures, and wherein at least one of:

at least a portion of the first aiming zone; or at least a portion of the second aiming zone is disposed in at least one of the aiming zone apertures.

11. The archery target of claim 1 wherein the overlay includes one or more aiming zone apertures, and wherein at least one of the first aiming zone or the second aiming zone is visible through at least one of the aiming zone apertures.

12. An archery target comprising:

a target body, wherein the target body comprises:

a width disposed between a first end and a second opposing end;

a first end comprising a first surface, wherein the first surface comprises a first aiming zone, and wherein the first aiming zone protrudes from the first surface of the target body, and wherein the first aiming zone comprises a first size corresponding to a first set of animals;

a second opposing end comprising a second surface, wherein the second surface comprises a second aiming zone, and wherein the second aiming zone protrudes from the second surface of the target body, and wherein the second aiming zone corresponds to a second set of animals, and wherein the second set of animals are smaller in size than the first set of animals, and wherein the second aiming zone is smaller in size than the first aiming zone;

a mounting frame coupleable to the target body, wherein the mounting frame at least partially supports the target body;

a mounting strap, wherein the mounting strap is disposed at least partially around a periphery surface of the target body, and wherein the mounting strap couples the mounting frame and the target body;

a replaceable overlay, wherein the replaceable overlay is similar to at least a portion of an animal.

13. The archery target of claim 12 wherein the first surface further comprises a first central axis perpendicular to the width of the target body, and wherein the first aiming zone is disposed off center with respect to the first central axis of the first surface.

14. The archery target of claim 12 wherein the second surface comprises a first central axis perpendicular to the width of the target body, and wherein the second aiming zone is disposed off center with respect to the first central axis of the second surface.

15. The archery target of claim 12 wherein the overlay is replaceable.

16. The archery target of claim 12 wherein the mounting frame comprises adjustable legs.

17. The archery target of claim 12 wherein the mounting frame is directly coupled to the target body.

18. The archery target of claim 12 wherein the mounting strap allows rotation of the target body.

19. The archery target of claim 12 wherein the mounting strap includes pockets, and wherein each pocket is adapted to receive at least a portion of one or more legs of the mounting frame.

20. The archery target of claim 12 wherein the overlay includes one or more aiming zone apertures, and wherein at least one of:

at least a portion of the first aiming zone; or at least a portion of the second aiming zone is disposed in at least one of the aiming zone apertures.

21. The archery target of claim 12 wherein the overlay includes one or more aiming zone apertures, and wherein at least one of the first aiming zone or the second aiming zone is visible through at least one of the aiming zone apertures.

22. The archery target of claim 12 wherein the at least one of the first aiming zone or the second aiming zone is replaceable.

* * * * *